US008636465B2

(12) United States Patent
Durocher et al.

(10) Patent No.: US 8,636,465 B2
(45) Date of Patent: Jan. 28, 2014

(54) GAS TURBINE ENGINE THERMAL EXPANSION JOINT

(75) Inventors: Eric Durocher, Vercheres (CA); Guy Lefebvre, St. Bruno de Montarville (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 1384 days.

(21) Appl. No.: 12/571,909

(22) Filed: Oct. 1, 2009

(65) Prior Publication Data

US 2011/0081234 A1 Apr. 7, 2011

(51) Int. Cl.
*F01D 25/26* (2006.01)

(52) U.S. Cl.
USPC ..... 415/136; 415/214.1; 60/799; 403/30; 411/171; 29/889.2; 29/426.4; 29/525.14

(58) Field of Classification Search
USPC ..... 415/134–139, 213.1, 214.1; 60/797, 60/799; 403/28–30; 411/171; 29/889.2, 29/402.08, 426.4, 525.01, 525.14; 285/187, 224, 288.1, 288.2, 288.4, 285/288.5, 288.6, 290.5, 329
See application file for complete search history.

(56) References Cited

U.S. PATENT DOCUMENTS

| | | | | | |
|---|---|---|---|---|---|
| 1,877,157 | A | * | 9/1932 | Cannon | 411/171 |
| 2,752,172 | A | * | 6/1956 | Ziebold | 285/288.4 |
| 2,955,800 | A | * | 10/1960 | Miller et al. | 415/138 |
| 3,807,891 | A | * | 4/1974 | McDow et al. | 415/134 |
| 3,829,233 | A | * | 8/1974 | Scalzo et al. | 415/136 |
| 3,930,675 | A | | 1/1976 | Sasse | |
| 4,247,248 | A | * | 1/1981 | Chaplin et al. | 415/136 |
| 4,318,668 | A | * | 3/1982 | Chaplin et al. | 415/135 |
| 4,920,742 | A | | 5/1990 | Nash et al. | |
| 5,133,640 | A | | 7/1992 | Groenendaal, Jr. et al. | |
| 5,224,822 | A | * | 7/1993 | Lenahan et al. | 415/189 |
| 5,289,677 | A | * | 3/1994 | Jarrell | 60/796 |
| 5,386,676 | A | | 2/1995 | Kidaloski et al. | |
| 5,609,467 | A | | 3/1997 | Lenhart et al. | |
| 5,797,723 | A | * | 8/1998 | Frost et al. | 415/174.2 |
| 6,347,508 | B1 | * | 2/2002 | Smallwood et al. | 60/796 |
| 6,807,059 | B1 | | 10/2004 | Dale | |
| 7,210,899 | B2 | | 5/2007 | Wilson, Jr. | |
| 7,342,989 | B2 | | 3/2008 | Pennington et al. | |
| 7,494,317 | B2 | | 2/2009 | Keller et al. | |
| 2010/0077913 | A1 | * | 4/2010 | Cunningham et al. | 29/525.14 |

* cited by examiner

*Primary Examiner* — Christopher Verdier

(74) *Attorney, Agent, or Firm* — Norton Rose Fulbright Canada LLP

(57) ABSTRACT

A thermal expansion joint apparatus includes an insert extending through respective first and second components to loosely restrain the first component between the second component and an enlarged head of the insert, thereby allowing thermal expansion of the respective first and second components relative to each other. The insert is secured to the second component by a fastener which can be removed, for example, when the insert is to be removed from the engine.

14 Claims, 5 Drawing Sheets

GAS TURBINE ENGINE THERMAL EXPANSION JOINT

TECHNICAL FIELD

The described subject matter relates generally to gas turbine engines and, more particularly, to an improved thermal expansion joint for a gas turbine engine.

BACKGROUND OF THE ART

Gas turbine engines have zones such as turbine sections which provide an elevated temperature working environment during engine operation. Engine components located in such an elevated working environment experience dramatic temperature changes between engine operation and non-operation conditions, resulting in thermal expansion and/or contraction. Due to different thermal expansion/contraction characteristics of engine components connected one to another, thermal expansion joints are widely used to allow thermal expansion/contraction of the connected components independently one from another in order to minimize thermal stress in the engine structures. Thermal expansion joints of various types are used in gas turbine engines. However, conventional thermal expansion joints have some shortcomings. For example, restoration of contact faces of conventional thermal joints where fretting and wear marks are observed, is not convenient.

Accordingly, there is a need to provide an improved thermal expansion joint for gas turbine engines.

SUMMARY OF THE INVENTION

According to one aspect, the described subject matter provides a thermal expansion joint for a turbine engine, comprising a second engine component having a generally radially-extending wall, the wall defining a slot; a first engine component disposed adjacent the second engine component and having at least one radially-extending surface adjacent the wall, the first and second components having differing thermal expansion coefficients; an insert extending into an axial passage defined in the radial surface of the first component, the insert aligned to be matingly received in the slot, the insert and slot respectively configured to allow for differential thermal radial expansion between the first and second components; and a removable fastener retaining the insert to the first component.

In accordance with another aspect, the described subject matter provides a method for joining an engine component to a radial wall of a stationary structure of a turbine engine, the method comprising providing the engine component, the component having an insert extending through an axial passage of the component; inserting the insert into an axial hole extending from a first radial surface through the radial wall toward a second radial surface of the radial wall, thereby loosely restraining the component between the first radial surface of the radial wall and an enlarged head of the insert; and joining an end of the insert and the second radial surface of the radial wall together.

In accordance with a further aspect, the described subject matter provides an apparatus for joining components of a gas turbine engine while allowing thermal expansion/contraction thereof relative to each other, comprising a first component having opposed first and second surfaces and defining a hole extending through the first component between the opposed surfaces; a second component having at least one surface and defining a passage extending from the at least one surface through the component, the at least one surface abutting the first surface of the first component; an insert having opposed first and second ends, and an enlarged head integrated with the first end, the insert extending through the passage of the second component and snugly received in the hole, thereby loosely restraining the second component between the enlarged head of the insert and the first component to allow thermal expansion of respective components relative to each other in a direction substantially perpendicular to the passage of the second component; and a tack weld as a removable fastener joining the second end of the insert and the second surface of the first component together.

Further details of these and other aspects of the described subject matter will be apparent from the detailed description and drawings included below.

DESCRIPTION OF THE DRAWINGS

Reference is now made to the accompanying drawings depicting aspects of the described subject matter, in which.

DETAILED DESCRIPTION OF THE PREFERRED EMBODIMENTS

Figure 1:
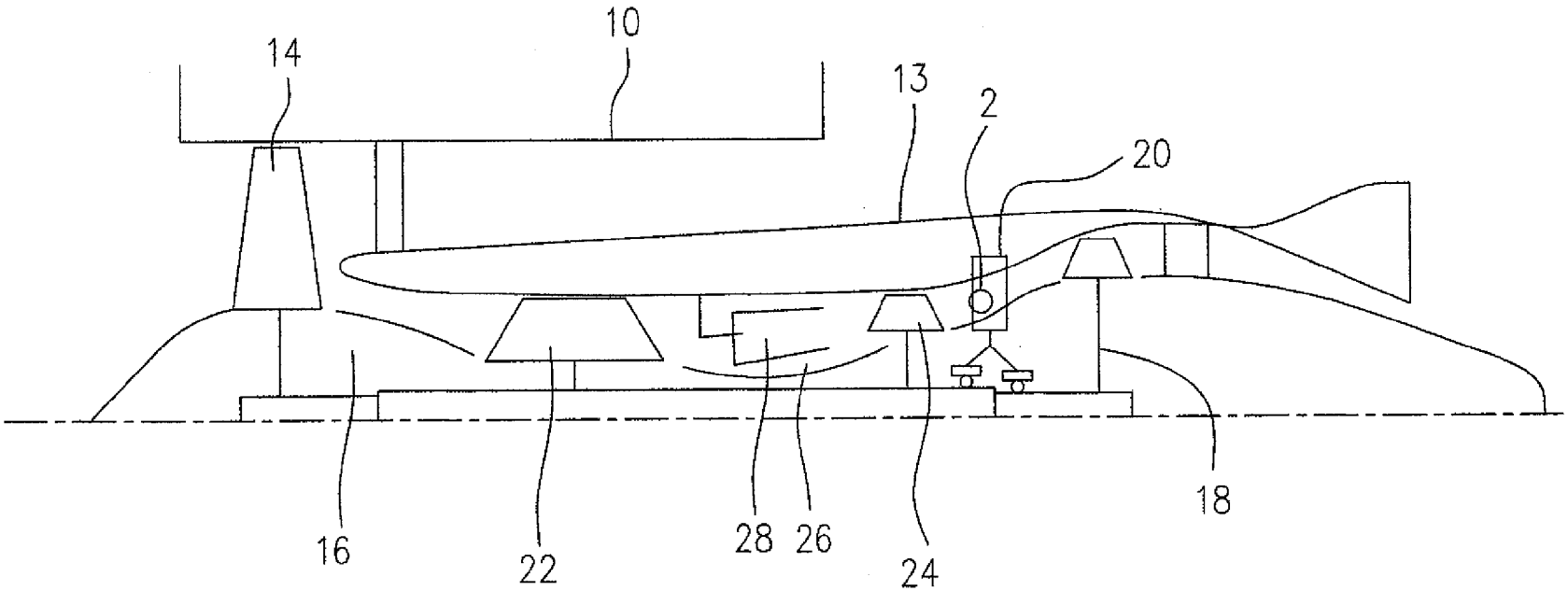
FIG. 1 is a schematic cross sectional view of an examplary gas turbine engine illustrating an elevated-temperature working environment wherein the described subject matter is applicable.

Referring to FIG. 1, a gas turbine engine presented as an example of the application of the described subject matter includes a housing or nacelle 10, a core casing 13, a low pressure spool assembly which includes a fan assembly 14, a low pressure compressor assembly 16 and a low pressure turbine assembly 18, and a high pressure spool assembly which includes a high pressure compressor assembly 22 and a high pressure turbine assembly 24. The core casing 13 surrounds the low and high pressure spool assemblies in order to define a main fluid path (not numbered) therethrough. In the main fluid path there is provided a combustor 28 to constitute a gas generator section 26. Generally, downstream of the gas generator section 26 are hot sections and any engine structures in the hot sections such as a mid-turbine frame 20 which is located between the high pressure turbine assembly 24 and the low pressure turbine assembly 18, may require thermal expansion joints for components connected therein.

Referring to FIGS. 1-4, a thermal expansion joint apparatus 30 according to one embodiment is used for engine components in a hot section such as the mid-turbine frame 20. The apparatus includes a first component such as a radial wall 32 as part of a stationary structure of the mid-turbine frame 20.

Figure 2:
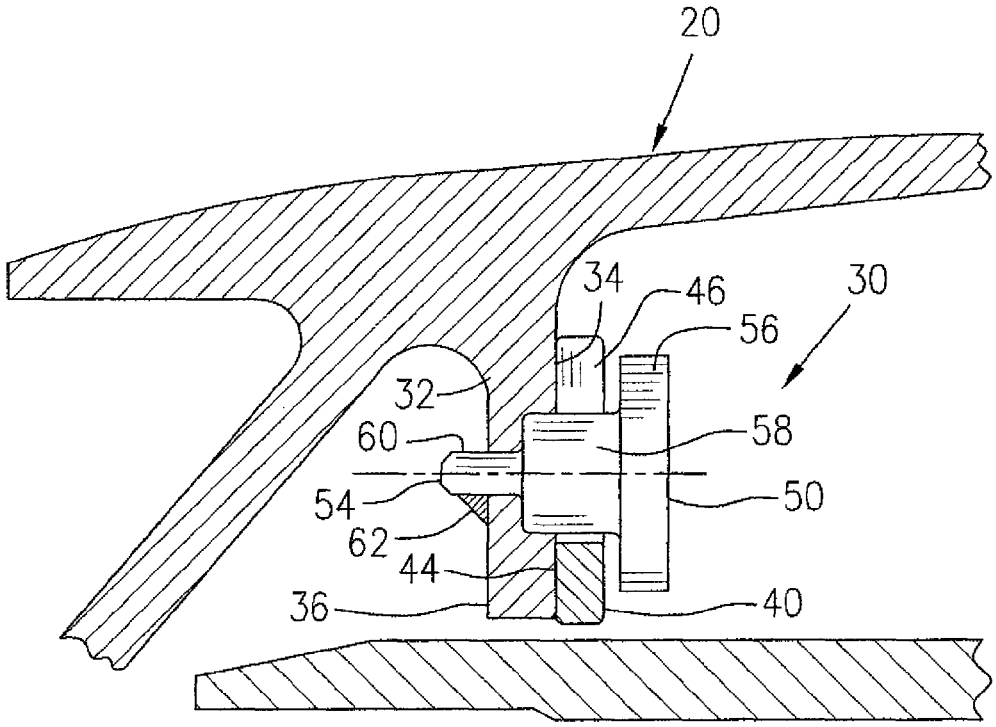
FIG. 2 is a partial cross-sectional view of the gas turbine engine of FIG. 1, taking an enlarged area in the circle indicated by numeral 2, illustrating a thermal expansion joint according to one embodiment.

The radial wall 32, for example, includes opposed radial surfaces 34 and 36, and one or more holes 38 (only one shown) axially extending through the radial wall 32 between the opposed radial surfaces 34, 36. It is noted that the respective radial and axial directions described throughout the disclosure and appended claims of this application are defined with respect to the axis of the engine as shown in FIG. 1 (not numbered), unless otherwise specified. The apparatus 30 further includes a second component having at least one radial surface 44, for example, a seal ring 40 having opposed radial surfaces 42, 44. An axial passage such as a radially oriented slot 46 axially extends through the seal ring 40 between the opposed radial surfaces 42, 44. The radially oriented slot 46 may define an opening (not numbered) in a periphery such as an outer periphery 48 of the seal ring 40. The seal ring 40 is placed against the radial wall 32 such that surface 44 of the seal ring 40 abuts the surface 34 of the radial wall 32 as shown in FIG. 2.

An insert 50 is provided which has opposed ends 52, 54 with an enlarged head 56 integrated with the end 52. Optionally, the insert 50 is generally cylindrical, having a substantially cylindrical stem 58 axially extending from the enlarged head 56 and having a substantially cylindrical end portion 60 extending axially from the stem 58 to form the end 54. The end portion 60 has a diameter less than the diameter of the stem 58.

It is optional to have the axial length of the stem 58 of the insert 50 less than the sum of the thicknesses of the radial wall 32 and the seal ring 40 and to have the hole 38 in the radial wall 32 configured accordingly. The seal ring 40 may be loosely restrained between the enlarged head 56 of the insert 50 and the radial wall 32 such that thermal radial expansion of the respective radial wall 32 and the seal ring 40 relative to each other, is allowed when the insert 50 extends through the slot 46 of the seal ring 40 and is snugly received in the hole 38 of the radial wall 32. In this configuration, the slot 46 in the seal ring 40 has a width slightly greater than the diameter of the stem 58 of the insert 50.

The hole 38 may have an enlarged portion (not numbered) to receive a portion of the stem 58 of the insert 50. The enlarged portion of the hole 38 may have a depth such that insertion of the insert 50 into the hole 38 is limited in order to provide an axial gap (not numbered) between the radial wall 32 and the enlarged head 56 of the insert, greater than the thickness of the seal ring 40. In use, a pressure differential between the seal ring 40 and the radial wall 32 presses the seal ring 40 against the radial wall 32 to maintain the abutment between the surface 34 of the radial wall 32 and the surface 44 of the seal ring 40. The radial dimension of the slot 46 is determined accordingly to allow an adequate margin for thermal radial expansion/contraction of the seal ring 40, independent of the connected radial wall 32.

The hole 38 in the radial wall 32, or at least one axial section of the hole 38 may be sized to snugly receive an axial section of the insert 50. For example, the stem 58 of the insert 50 may be snugly received in the enlarged portion of the hole 38 and/or the end portion 60 of the insert 50 may be snugly received in the remaining portion of the hole 38.

The insert 50 is secured to the radial wall 32 by a tack weld 62 (see FIG. 2) or other suitable removable fastener. In this example, the fastener joins the end 54 of the insert 50 and the radial surface 36 of the radial wall 32 together. The end 54 of the insert 50 is exposed from beyond the hole 38 at a side of the second radial surface of the radial wall 32 to allow the application of the tack weld 62.

The first and second components may have different thermal expansion coefficients and therefore may have different thermal expansion/contraction in response to the same temperature changes. The apparatus 30 is so configured as to allow the different thermal expansion/contraction of the first and second components.

According to this embodiment, at least one tack weld 62 provides a removable fastener to the apparatus 30. When the insert 50 is to be removed from the engine for replacement or repair during engine maintenance, the tack weld 62 may be removed by grinding, or other suitable removal technique. The tack weld 62 may be applied in only a desired circumferential location of the end portion 60 of the insert 50 for convenience of removing the tack weld 62 when desired in engine maintenance.

Figure 5:
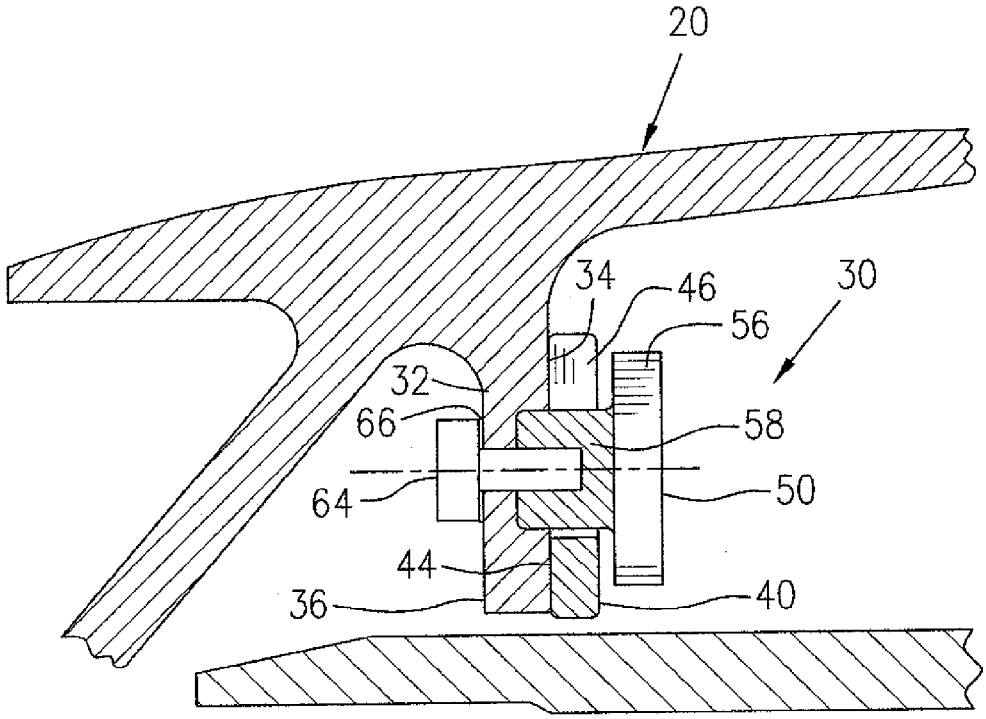
FIG. 5 is a partial cross-sectional view of the gas turbine engine, similar to that of FIG. 2, illustrating the thermal expansion joint according to another embodiment.

Alternately, any other suitable fastener apparatus may be employed. For example, as shown in FIG. 5, a pin 64 may be threaded or press fit into a hole (not numbered) of the stem 58 of the insert 50. Locking helicoil, lockwire, etc. may be employed. Alternatively, the pin 64 may also be locked by the temporary tack welds or by brazing.

Optionally, the end portion 60 of the insert 50 projects axially out of the surface 36 of the radial wall 32. The tack weld 62 is therefore applied between the projecting section of the end portion 60 of the insert 50 and the radial surface 36 of the radial wall 32.

Figure 4:
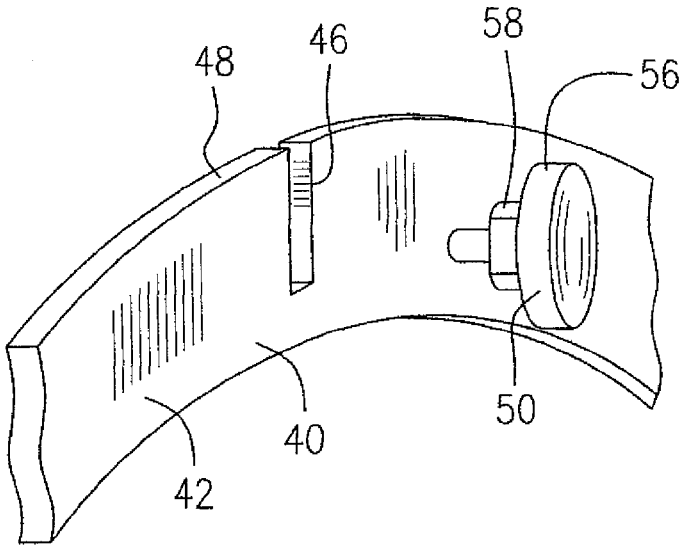
FIG. 4 is an exploded partial perspective view of the thermal joint of FIG. 2, showing a ring component and an insert only.
Figure 3:
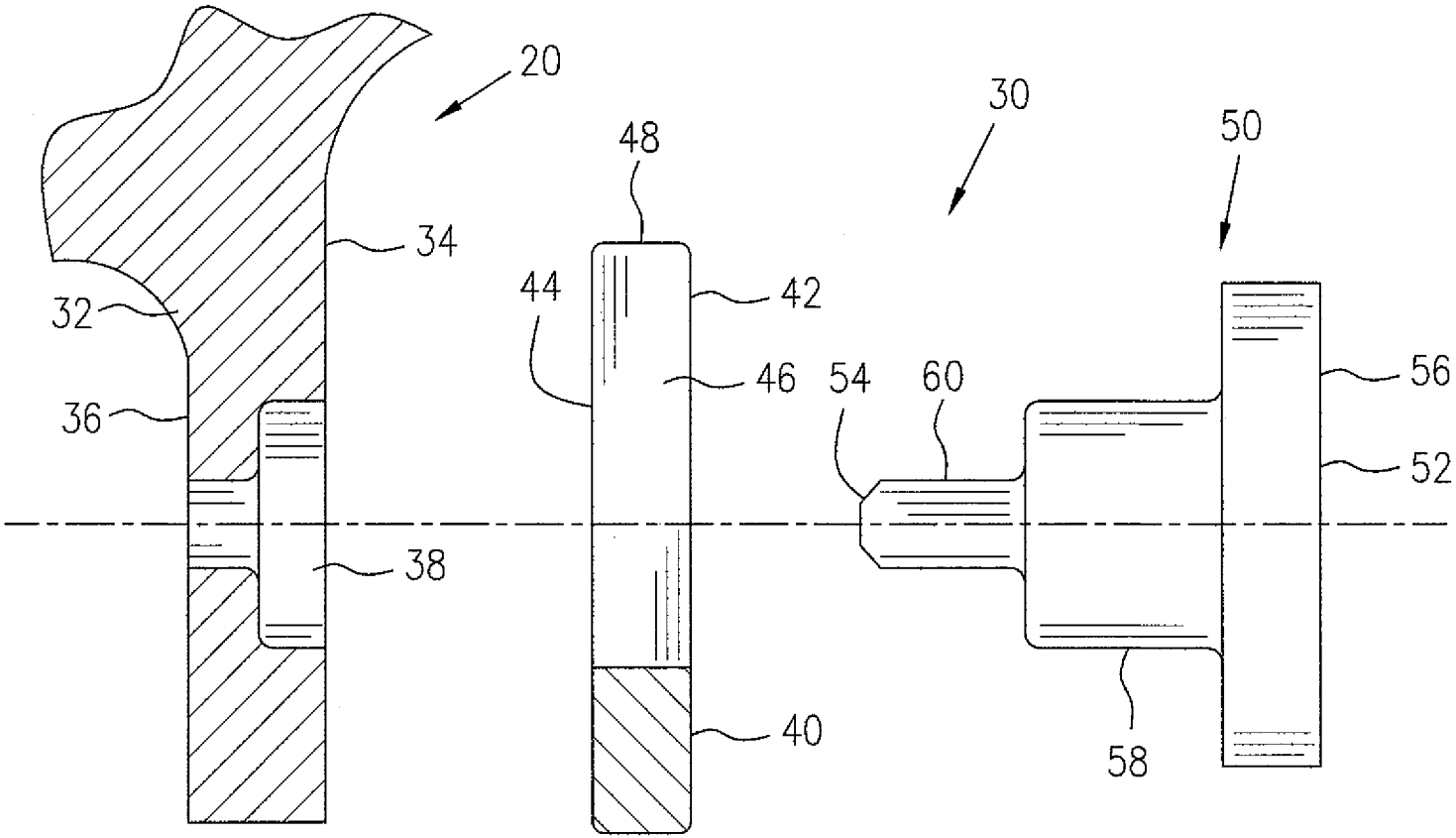
FIG. 3 is an exploded cross-section view of the thermal expansion joint of FIG. 2, without a tack weld applied thereto.
Figure 6:
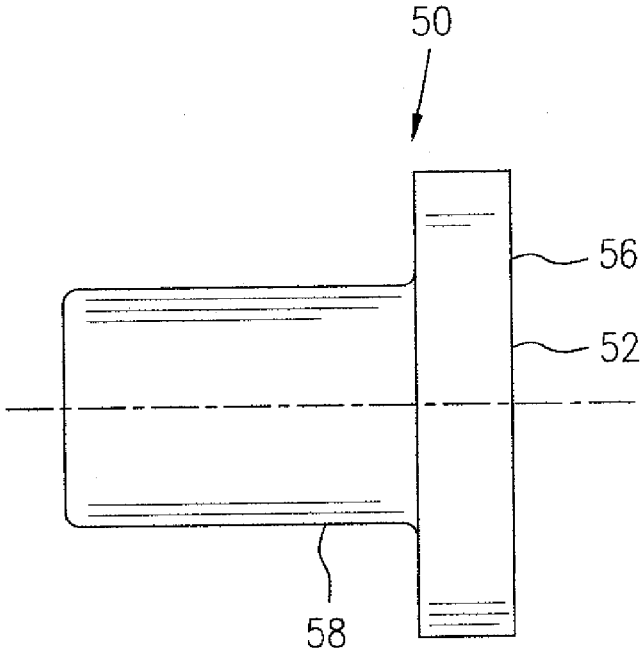
FIG. 6 is a side elevational view of the thermal expansion joint according to a further embodiment.

As an alternative to the cylindrical stem 58 of FIG. 2, the stem 58 may have squared faces or at least may include two opposed flat surfaces as shown in FIG. 4. Optionally, the stem 58 may not have the smaller end portion 60 of FIG. 2, but may extend axially with a consistent dimension in a transverse cross-section, as shown in FIG. 6.

Figure 7:
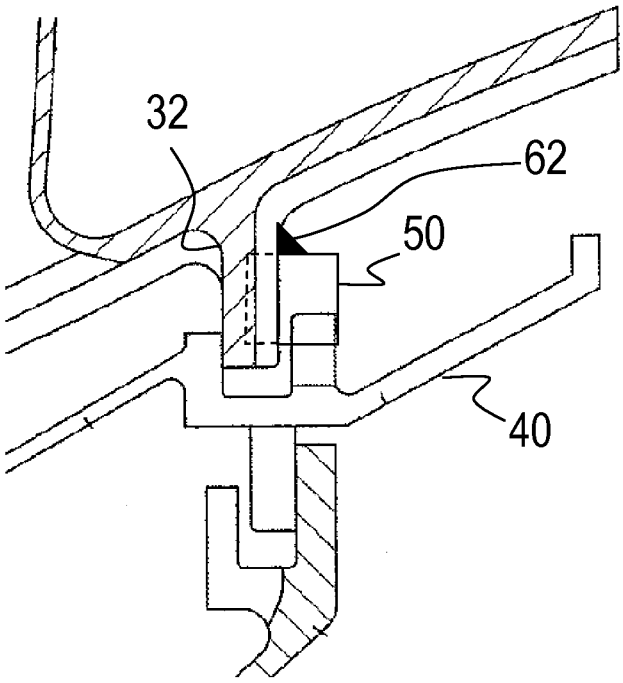
FIG. 7 is a partial cross-sectional view of a gas turbine engine, showing the thermal expansion joint according to a further embodiment.

In another example thermal expansion joint, shown in FIG. 7, the insert 50 is configured more or less like a conventional lug, but is secured to the first component 32 by a tack weld 62, as described above. In this example, both the first component 32 and a second component 40 are perhaps more complicated (i.e. multi-function) components than in the examples above, such as a gas path duct and an associated heat shield, or similar. This example thus illustrates that the present concept may be used in any suitable configuration in any suitable thermal expansion joint.

The above description is meant to be examplary only, and one skilled in the art will recognize that changes may be made to the embodiments described without departure from the scope of the described subject matter. For example, a seal ring attached to a mid-turbine frame is used for the examplary embodiment described above, however, it is understood that the apparatus and the method described in this application are applicable for joining other components of a gas turbine engine while allowing thermal expansion/contraction thereof relative to each other. Although thermal expansion/contraction in a radial direction is discussed in the above described embodiment, it is understood that the apparatus and method described above may also be applicable to allow thermal expansion/contraction in other directions which are substantially perpendicular to the passages of the components receiving the insert. Still, other modifications which fall within the scope of the described subject matter will be apparent to those skilled in the art, in light of a review of this disclosure, and such modifications are intended to fall within the appended claims.

The invention claimed is:

1. A thermal expansion joint for a turbine engine, comprising:

a second engine component having a generally radially-extending wall, the wall defining a slot;

a first engine component disposed adjacent the second engine component and having at least one radially-extending surface adjacent the wall of the second component, the first and second components having differing thermal expansion coefficients;

an insert having a stem with an enlarged head at one end and an end portion at the other end, the end portion having a radial diameter less than a diameter of the stem, the insert extending into an axial passage defined in the at least one radially extending surface of the first component, the axial passage having an enlarged section with a limited depth to receive a portion of the stem, resulting in an axial gap between the radial surface of the first component and the enlarged head, the insert aligned to be matingly received in the slot, the insert and slot respectively configured to allow for different thermal radial expansion between the first and second components while the second component is axially restrained by the gap; and a removable fastener retaining the insert to the first component.

2. The thermal expansion joint as defined in claim 1 wherein the fastener comprises at least one tack weld.

3. The thermal expansion joint as defined in claim 1 wherein the second component comprises a ring having opposed first and second radial surfaces to define the wall therebetween.

4. The thermal expansion joint as defined in claim 3 wherein the slot is radially oriented in the ring.

5. The thermal expansion joint as defined in claim 4 wherein the slot defines an opening in a periphery of the ring.

6. The thermal expansion joint as defined in claim 1 wherein a section of the end portion of the insert projects axially out of a second radial surface of the first component opposite to the at least one radial surface.

7. The thermal expansion joint as defined in claim 6 wherein a tack weld is applied between the second radial surface of the first component and the projecting section of the stem.

8. The thermal expansion joint as defined in claim 7 wherein the tack weld is positioned in only a circumferential fragment of the projecting section of the stem.

9. The thermal expansion joint as defined in claim 1 wherein at least one axial section of the axial passage of the first component is sized to snugly receive an axial section of the stem of the insert.

10. The thermal expansion joint as defined in claim 1 wherein the stem of the insert is substantially cylindrical.

11. The thermal expansion joint as defined in claim 1 wherein the stem of the insert comprises opposed flat side surfaces.

12. An apparatus for joining components of a gas turbine engine while allowing thermal expansion/contraction thereof relative to each other, comprising:

a first component having opposed first and second surfaces and defining a hole extending through the first component between the opposed surfaces, the hole having an enlarged section with limited depth;

a second component having at least one surface and defining a passage extending from the at least one surface through the second component, the at least one surface of the second component abutting the first surface of the first component;

an insert having opposed first and second ends, and an enlarged head at the first end integrated with a stem, the insert extending through the passage of the second component and the stem being snugly received in the enlarged section of the hole, thereby loosely and axially restraining the second component between the enlarged head of the insert and the first component to allow thermal expansion of respective components relative to each other in a direction substantially perpendicular to the passage of the second component; and a tack weld as a removable fastener joining the second end of the insert and the second surface of the first component together.

13. The apparatus as defined in claim 12 wherein the second end of the insert projects from the second surface of the first component.

14. The apparatus as defined in claim 13 wherein the tack weld is positioned in only a circumferential fragment of the second end of the insert.

* * * * *